US010136213B2

(12) United States Patent
Sänger et al.

(10) Patent No.: US 10,136,213 B2
(45) Date of Patent: Nov. 20, 2018

(54) MICROPHONE MODULE WITH SHARED MIDDLE SOUND INLET ARRANGEMENT

(71) Applicant: Sonion Nederland B.V., Hoofddorp (NL)

(72) Inventors: Anne-Marie Sänger, Koog a/d Zaan (NL); Arkadiusz Wasylków, Amsterdam (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/019,103

(22) Filed: Feb. 9, 2016

(65) Prior Publication Data

US 2016/0234591 A1 Aug. 11, 2016

(30) Foreign Application Priority Data

Feb. 10, 2015 (EP) ..... 15154474

(51) Int. Cl.

| | |
|---|---|
| ***H04R 1/08*** | (2006.01) |
| ***H04R 9/08*** | (2006.01) |
| ***H04R 1/28*** | (2006.01) |
| ***H04R 1/32*** | (2006.01) |
| ***H04R 25/00*** | (2006.01) |

(52) U.S. Cl.

CPC ..... *H04R 1/2884* (2013.01); *H04R 1/326* (2013.01); *H04R 25/405* (2013.01); *H04R 2201/003* (2013.01)

(58) Field of Classification Search

CPC ..... H04R 1/08; H04R 9/08; H04R 11/04; H04R 17/02; H04R 21/02

USPC ..... 381/355–359

See application file for complete search history.

(56) References Cited

U.S. PATENT DOCUMENTS

| | | | | |
|---|---|---|---|---|
| 2,552,878 A * | 5/1951 | Wiggins | H04R 1/38 381/173 |
| 3,995,124 A * | 11/1976 | Gabr | H04R 1/227 381/186 |
| 5,473,701 A | 12/1995 | Cezanne | |
| 6,788,796 B1 | 9/2004 | Miles et al. | |
| 6,831,577 B1 | 12/2004 | Furst | |

(Continued)

FOREIGN PATENT DOCUMENTS

| | | |
|---|---|---|
| EP | 2107823 | 10/2009 |
| EP | 2723102 | 4/2014 |

(Continued)

OTHER PUBLICATIONS

European Search Report for Application No. EP 15154474, dated Aug. 26, 2015 (2 pages).

*Primary Examiner* — Suhan Ni

(74) *Attorney, Agent, or Firm* — Nixon Peabody LLP

(57) ABSTRACT

The present invention relates to a microphone module comprising a first directional microphone comprising a front sound inlet and a front membrane, a second directional microphone comprising a rear sound inlet and a rear membrane, and a middle sound inlet arrangement being acoustically connected to the front and rear membranes, said middle sound inlet arrangement comprising acoustical resistance means arranged at least partly therein. The microphone module aims at generating a cardioid and an anti-cardioid response, or alternatively any other back-to-back polar patterns.

17 Claims, 8 Drawing Sheets

(56) References Cited

U.S. PATENT DOCUMENTS

| | | | |
|---|---|---|---|
| 6,853,290 | B2 | 2/2005 | Jorgensen et al. |
| 6,859,542 | B2 | 2/2005 | Johannsen et al. |
| 6,888,408 | B2 | 5/2005 | Furst et al. |
| 6,914,992 | B1 | 7/2005 | van Halteren et al. |
| 6,919,519 | B2 | 7/2005 | Ravnkilde et al. |
| 6,930,259 | B1 | 8/2005 | Jorgensen et al. |
| 6,943,308 | B2 | 9/2005 | Ravnkilde et al. |
| 6,974,921 | B2 | 12/2005 | Jorgensen et al. |
| 7,008,271 | B2 | 3/2006 | Jorgensen |
| 7,012,200 | B2 | 3/2006 | Moller |
| 7,062,058 | B2 | 6/2006 | Steeman et al. |
| 7,062,063 | B2 | 6/2006 | Hansen et al. |
| 7,072,482 | B2 | 7/2006 | Van Doom et al. |
| 7,088,839 | B2 | 8/2006 | Geschiere et al. |
| 7,110,560 | B2 | 9/2006 | Stenberg |
| 7,136,496 | B2 | 11/2006 | van Halteren et al. |
| 7,142,682 | B2 | 11/2006 | Mullenbom et al. |
| 7,181,035 | B2 | 2/2007 | van Halteren et al. |
| 7,190,803 | B2 | 3/2007 | van Halteren |
| 7,206,428 | B2 | 4/2007 | Geschiere et al. |
| 7,221,767 | B2 | 5/2007 | Mullenbom et al. |
| 7,221,769 | B1 | 5/2007 | Jorgensen |
| 7,227,968 | B2 | 6/2007 | van Halteren et al. |
| 7,239,714 | B2 | 7/2007 | de Blok et al. |
| 7,245,734 | B2 | 7/2007 | Niederdraenk |
| 7,254,248 | B2 | 8/2007 | Johannsen et al. |
| 7,286,680 | B2 | 10/2007 | Steeman et al. |
| 7,292,700 | B1 | 11/2007 | Engbert et al. |
| 7,292,876 | B2 | 11/2007 | Bosh et al. |
| 7,336,794 | B2 | 2/2008 | Furst et al. |
| 7,376,240 | B2 | 5/2008 | Hansen et al. |
| 7,403,630 | B2 | 7/2008 | Jorgensen et al. |
| 7,415,121 | B2 | 8/2008 | Mögelin et al. |
| 7,425,196 | B2 | 9/2008 | Jorgensen et al. |
| 7,460,681 | B2 | 12/2008 | Geschiere et al. |
| 7,466,835 | B2 | 12/2008 | Stenberg et al. |
| 7,492,919 | B2 | 2/2009 | Engbert et al. |
| 7,548,626 | B2 | 6/2009 | Stenberg et al. |
| 7,657,048 | B2 | 2/2010 | van Halteren et al. |
| 7,684,575 | B2 | 3/2010 | van Halteren et al. |
| 7,706,561 | B2 | 4/2010 | Wilmink et al. |
| 7,715,583 | B2 | 5/2010 | Van Halteren et al. |
| 7,728,237 | B2 | 6/2010 | Pedersen et al. |
| 7,809,151 | B2 | 10/2010 | Van Halteren et al. |
| 7,822,218 | B2 | 10/2010 | Van Halteren |
| 7,899,203 | B2 | 3/2011 | Van Halteren et al. |
| 7,912,240 | B2 | 3/2011 | Madaffari et al. |
| 7,946,890 | B1 | 5/2011 | Bondo et al. |
| 7,953,241 | B2 | 5/2011 | Jorgensen et al. |
| 7,961,899 | B2 | 6/2011 | Van Halteren et al. |
| 7,970,161 | B2 | 6/2011 | van Halteren |
| 8,098,854 | B2 | 1/2012 | van Halteren et al. |
| 8,101,876 | B2 | 1/2012 | Andreasen et al. |
| 8,103,039 | B2 | 1/2012 | van Halteren et al. |
| 8,160,290 | B2 | 4/2012 | Jorgensen et al. |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman et al. |
| 8,233,652 | B2 | 7/2012 | Jorgensen et al. |
| 8,254,609 | B2 | 8/2012 | Lin |
| 8,259,963 | B2 | 9/2012 | Stenberg et al. |
| 8,259,976 | B2 | 9/2012 | van Halteren |
| 8,259,977 | B2 | 9/2012 | Jorgensen et al. |
| 8,280,082 | B2 | 10/2012 | van Halteren et al. |
| 8,284,966 | B2 | 10/2012 | Wilk et al. |
| 8,313,336 | B2 | 11/2012 | Bondo et al. |
| 8,315,422 | B2 | 11/2012 | van Halteren et al. |
| 8,331,595 | B2 | 12/2012 | van Halteren |
| 8,369,552 | B2 | 2/2013 | Engbert et al. |
| 8,379,899 | B2 | 2/2013 | van Halteren et al. |
| 8,509,468 | B2 | 8/2013 | van Halteren et al. |
| 8,526,651 | B2 | 9/2013 | Lafort et al. |
| 8,526,652 | B2 | 9/2013 | Ambrose et al. |
| 9,781,523 | B2 * | 10/2017 | Kuster ..... H04R 25/405 |
| 2007/0177752 | A1 * | 8/2007 | Kargus, IV ..... H04R 1/38 381/357 |
| 2009/0094817 | A1 * | 4/2009 | Killion ..... H04R 1/38 381/356 |
| 2009/0252365 | A1 * | 10/2009 | Lin ..... H04R 1/08 381/369 |
| 2011/0182453 | A1 | 7/2011 | van Hal et al. |
| 2011/0189880 | A1 | 8/2011 | Bondo et al. |
| 2011/0299708 | A1 | 12/2011 | Bondo et al. |
| 2011/0299712 | A1 | 12/2011 | Bondo et al. |
| 2011/0311069 | A1 | 12/2011 | Ambrose et al. |
| 2012/0014548 | A1 | 1/2012 | van Halteren |
| 2012/0027245 | A1 | 2/2012 | van Halteren et al. |
| 2012/0140966 | A1 | 6/2012 | Mocking et al. |
| 2012/0155683 | A1 | 6/2012 | van Halteren |
| 2012/0155694 | A1 | 6/2012 | Reeuwijk et al. |
| 2012/0255805 | A1 | 10/2012 | van Halteren et al. |
| 2013/0028451 | A1 * | 1/2013 | de Roo ..... H04R 1/38 381/356 |
| 2013/0108089 | A1 * | 5/2013 | Lin ..... H04R 1/08 381/313 |
| 2013/0136284 | A1 | 5/2013 | van Hal et al. |
| 2013/0142370 | A1 | 6/2013 | Engbert et al. |
| 2013/0163799 | A1 | 6/2013 | Van Halteren |
| 2013/0195295 | A1 | 8/2013 | van Halteren et al. |

FOREIGN PATENT DOCUMENTS

| | | |
|---|---|---|
| WO | WO 2012/139230 | 10/2012 |
| WO | WO 2014/012582 | 1/2014 |

* cited by examiner

MICROPHONE MODULE WITH SHARED MIDDLE SOUND INLET ARRANGEMENT

CROSS REFERENCE TO RELATED APPLICATIONS

This application claims the benefit of European Patent Application Serial No. EP 15154474.9, filed Feb. 10, 2015, and titled "Microphone Module with Shared Middle Sound Inlet Arrangement," which is incorporated herein by reference in its entirety.

FIELD OF THE INVENTION

The present invention relates to a microphone module comprising first and second directional microphones having back-to-back polar patterns. In particular, the present invention relates to a microphone module comprising a first directional microphone having a cardioid polar pattern, and a second directional microphone having an anti-cardioid polar pattern. Moreover, the present invention relates to a hearing aid comprising such a microphone module.

BACKGROUND OF THE INVENTION

Various techniques to achieve directional hearing in a hearing aid have been suggested over the years. Examples of such techniques are as follows:

Matched pair of two omni-directional microphones: Directional hearing in hearing aids may be achieved by the use of a matched pair of two omni-directional microphones. To generate a directional output signal the signals from the omni-directional microphones are subtracted. An electrical time delay may be applied to one of the signals to shift the notch angle of the polar pattern. It is a disadvantage of the matched pair that in case of a mismatch/drift the directivity degrades heavily, in particular in the low frequency ranges. Moreover, matching microphones as well as amplitude/phase correction in the hearing aid production are time consuming manual operations.

Analogue directional microphone: Directional hearing in a hearing aid may also be achieved by the use of an analogue directional microphone. An analogue directional microphone is a microphone with one sound port in the front and one sound port in the rear volume. The advantage of an analogue directional microphone is that directionality cannot be degraded by drift or mismatch. However, the notch angle is at a fixed position and cannot be shifted by processing for beam forming purposes.

WO 2012/139230 discloses PU microphone module consisting of one omni-directional microphone (P) and one analogue directional microphone (U). The microphone module has two ports. The directional microphone picks up the pressure difference between front and rear port. In one embodiment the omni-directional microphone picks up the pressure at the front port of the module. Another embodiment is that the omni-directional microphone picks up the average of the pressures at front and rear port. The advantage of the PU microphone module is that the directional output is robust to compensate for mismatch/drift because it makes use of an analogue directional microphone which has a stable notch at 90 degree. The closer the desired notch angle is to 90 degree the smaller the impact of mismatch/drift on directionality. However, for notch angles close to 180 degree mismatch/drift still have a significant impact on directionality.

The so-called Jacobian module, cf. for example U.S. Pat. No. 8,254,609 comprises two directional microphones and one omni-directional microphone. The main advantage of the Jacobian principle is that a higher order directionality can be obtained. However, it is a disadvantage that the two directional microphones need to be matched very tightly. In case of mismatch/drift the directivity of the module degrades heavily.

Finally, the Blumlein pair is a stereo recording technique (also known as M/S technique) that makes use of two directional microphones. One of the directional microphones has a cardioid polar pattern (notch at 180 degree) and the other one is a dipole (notch at 90 degree). The microphones are oriented in a 90 degree angle towards each other. It is disadvantage of the Blumlein pair that it is a rather bulky design that requires a significant amount of space.

U.S. Pat. No. 5,473,701 teaches a method of enhancing the signal-to-noise ratio of a microphone array with an adjustable polar pattern by signal processing means. For illustrative purposes, back-to-back cardioid sensors are applied in U.S. Pat. No. 5,473,701. The back-to-back cardioid sensors are obtained from a differential arrangement of two omni-directional microphones. The signal processing suggested in U.S. Pat. No. 5,473,701 is also applicable in relation to sensors of other back-to-back polar patterns than cardioids.

EP 2 107 823 A2 shows a microphone module comprising a first and a second directional microphone. According to paragraph [0029] of D1, an acoustical input port is provided for an omni-directional microphone 601 and a directional microphone 603, cf. FIG. 6 of EP 2 107 823 A2. Thus, there is in EP 2 107 823 A2 no disclosure of a middle sound inlet arrangement being acoustically connected to a front and a rear membrane of respective directional microphones.

EP 2 723 102 A2 teaches in relation to FIG. 4 and paragraph [0083] that a sound filtering element 60' can be used to divide a common rear volume into two separate rear volumes each having a membrane in acoustical connection thereto. Thus, there is in EP 2 723 102 A2 no disclosure of a sound inlet having an acoustical resistance inserted therein.

It may be seen as an object of embodiments of the present invention to provide a microphone module comprising first and second directional microphones having back-to-back polar patterns.

It may be seen as a further object of embodiments of the present invention to provide a microphone module comprising a first directional microphone having a cardioid polar pattern as well as a second directional microphone having an anti-cardioid polar pattern.

DESCRIPTION OF THE INVENTION

The above-mentioned objects are complied with by providing, in a first aspect, a microphone module comprising

- a first directional microphone comprising a front sound inlet being acoustically connected to a front membrane by a front volume,
- a second directional microphone comprising a rear sound inlet being acoustically connected to a rear membrane by a rear volume, and
- a middle sound inlet arrangement being acoustically connected to the front and rear membranes, said middle sound inlet arrangement comprising acoustical resistance means arranged at least partly therein.

The present invention aims at implementing and providing a microphone module, such as a hearing aid microphone module, having back-to-back polar patterns, such as a cardioid polar pattern and an anti-cardioid polar pattern. This may for example be implemented by providing a microphone module, wherein the first directional microphone has an essential cardioid polar pattern, and wherein second directional microphone has an essential anti-cardioid polar pattern.

The advantage of a microphone module comprising a directional microphone with a cardioid polar pattern as well as a directional microphone with an anti-cardioid polar pattern (or any other back-to-back polar patterns) is that the directionality of the output signals of such a microphone module is essentially unaffected by microphone mismatch and drift in particular at low frequencies. The microphones forming the microphone module of the present invention may in principle be any kind of microphones, including electret microphones, micro-electromechanical system (MEMS) microphones etc.

As it will be addressed in the following the middle sound inlet arrangement may be implemented in various ways. Thus, it may be implemented as a shared sound inlet being acoustically connected to a plurality of volumes or it may be implemented as a plurality of individual sound inlets where each of said individual sound inlets may be acoustically connected to one or more volumes.

In a very compact design of the microphone module according to the present invention the middle sound inlet arrangement may thus comprise a single sound inlet being acoustically connected to a shared middle volume of the first and second directional microphones. The shared middle volume is acoustically connected to the front and the rear membrane. The front and rear volumes of the first and second directional microphones may be separated. The first and second directional microphones may be adjacently arranged, and the middle sound inlet arrangement in the form of a single sound inlet may be positioned off-centre, i.e. in an asymmetric manner relative to the front and rear volumes, and to the microphone module as a whole.

In a more modular approach of the microphone module of the present invention the middle sound inlet arrangement may comprise a shared sound inlet being acoustically connected to respective middle volumes of the first and second directional microphones. The middle volume of the first directional microphone is acoustically connected to the front membrane. The middle volume of the second directional microphone is acoustically connected to the rear membrane. As indicated the middle volumes of the first and second directional microphones may be separated. Similarly, the front and rear volumes of the first and second directional microphones may be separated as well.

Alternatively, the middle sound inlet arrangement may comprise separated first and second sound inlets, wherein the first sound inlet is acoustically connected to the middle volume of the first directional microphone, and wherein the second sound inlet is acoustically connected to the middle volume of the second directional microphone. The middle volume of the first directional microphone is acoustically connected to the front membrane. The middle volume of the second directional microphone is acoustically connected to the rear membrane. As indicated the middle volumes may be separated. Similarly, the front and rear volumes of the first and second directional microphones may be separated as well.

The first and second directional microphones may share a common microphone module housing or cabinet. This sharing of a common microphone module housing or cabinet is advantageous in that it significantly simplifies the mechanical construction of the microphone module. By incorporating the first and second directional microphones into a common microphone module housing or cabinet individual microphone housings or cabinets may be omitted.

In order to provide a simple pressure signal the microphone module according to the present invention may further comprise an omni-directional microphone. In this setup the middle sound inlet arrangement may form part of the omni-directional microphone. Also, the first and second directional microphones and the omni-directional microphone may share the same middle volume. The front and rear volumes of the directional microphones may be separated, and the rear volume of the omni-directional microphone may be separated. The omni-directional microphone may be included in the common microphone module housing or cabinet within which housing or cabinet the first and second directional microphones may be arranged as well.

Alternatively, the middle sound inlet arrangement may form part of one of the directional microphones, such as the microphone generating the cardioid response.

In a second aspect the present invention relates to a hearing aid comprising the microphone module according to the first aspect.

BRIEF DESCRIPTION OF THE DRAWINGS

The present invention will now be explained with reference to the accompanying figures where.

Figure 1:
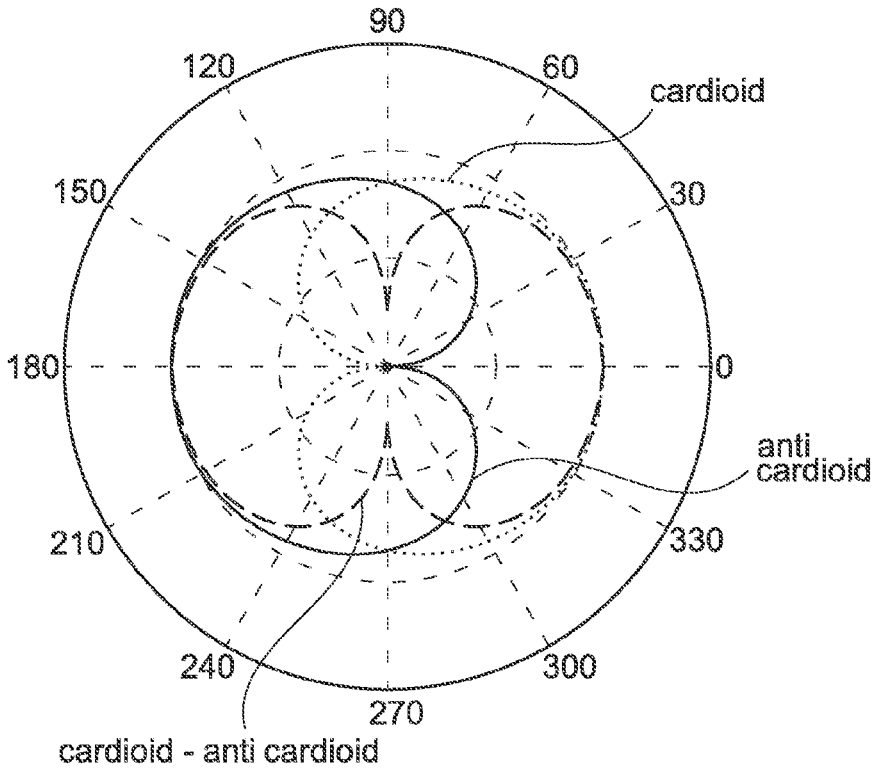
FIG. 1 shows a cardioid polar pattern, an anti-cardioid polar pattern and a cardioid minus anti-cardioid polar pattern.

While the invention is susceptible to various modifications and alternative forms specific embodiments have been shown by way of examples in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a microphone module, such as a hearing aid microphone module, comprising two directional microphones providing back-to-back polar patterns. For illustrative purposes, one directional microphone may have a cardioid polar pattern whereas the other directional microphone may have an anti-cardioid polar pattern. The cardioid and the anti-cardioid polar pattern are thus provided by two robust directional microphones. No matter how much the directional microphones are mismatched they will always deliver a cardioid and an anti-cardioid. The microphone module of the present invention is thus a very robust module.

Referring now FIG. 1 a cardioid, an anti-cardioid and a combined cardioid/anti-cardioid polar pattern are depicted. The present invention is concerned with how to establish and provide such back-to-back polar patterns in for example a hearing aid microphone module. Various embodiments of the present invention are discussed separately in the following.

In the following various types of implementations of the microphone module of the present invention will be discussed. Each of the implementations involves at least a first and a second directional microphone. Each of the first and second directional microphones comprises a membrane. The microphone module of the present invention provides a first output signal being dependent on audio signals received by the membrane of the first directional microphone. In addition, the microphone module of the present invention provides a second output signal being dependent on audio signals received by the membrane of the second directional microphone. In fact the first and second output signals may be proportional to audio signals being received by the respective membranes of the first and second directional microphones.

Figure 2:
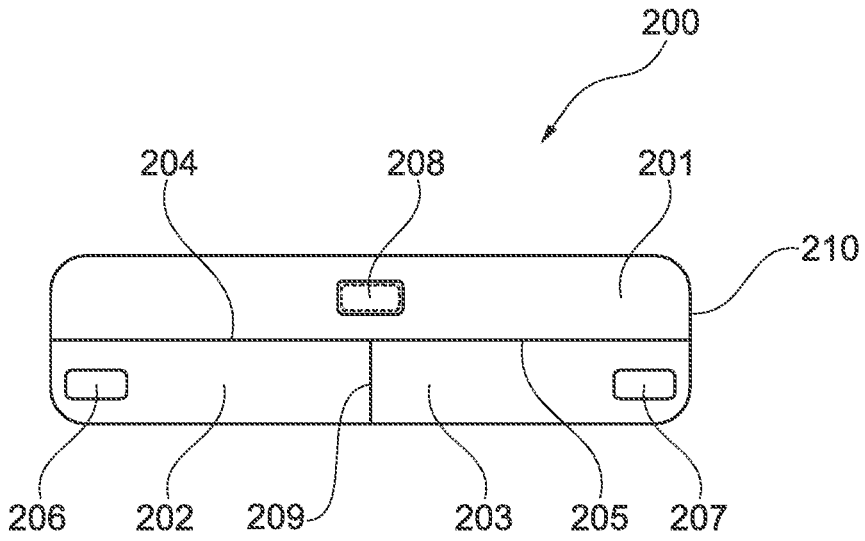
FIG. 2 shows a microphone module having a shared middle sound inlet and a shared middle volume.

Referring now to FIG. 2 a microphone module 200 comprising a shared middle volume 201, a front volume 202 and a rear volume 203 is depicted. The front and rear volumes are acoustical separated by a wall 209. The middle volume 201, the front volume 202 and the membrane 204 form a directional microphone having for instance a cardioid polar pattern. Similarly, the middle volume 201, the rear volume 203 and the membrane 205 form another directional microphone having for instance an anti-cardioid polar pattern. An acoustical resistance is arranged in sound inlet 208 whereas sound inlets 206 and 207 are holes. The acoustical resistance may be formed by a grid. The two directional microphones share the same outer housing or cabinet 210.

Figure 3:
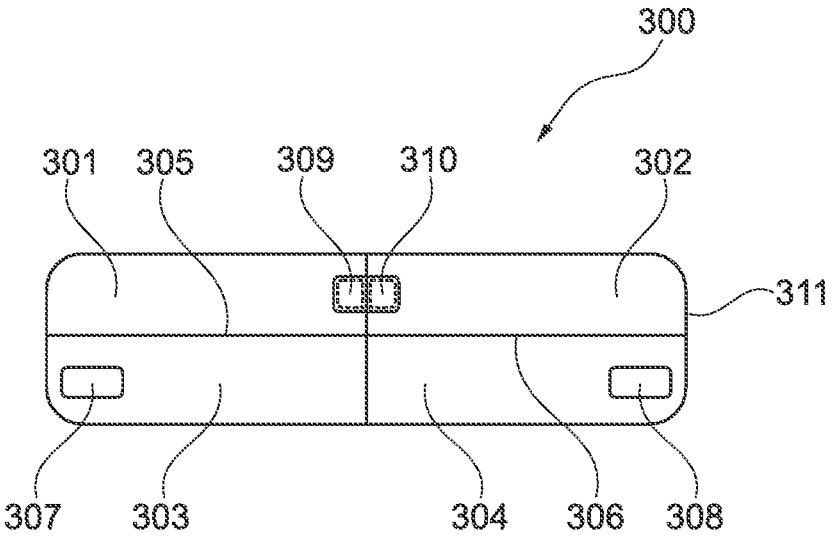
FIG. 3 shows a microphone module having a shared middle sound inlet and separated middle volumes.

In the embodiment 300 depicted in FIG. 3 the middle volume of FIG. 2 has been separated into middle volumes 301 and 302. The front 303 and rear 304 volumes are still separated and they are still in acoustical communication with sound inlets 307 and 308, respectively. The middle volume 301, the front volume 303 and the membrane 305 form a directional microphone having for instance a cardioid polar pattern. Similarly, the middle volume 302, the rear volume 304 and the membrane 306 form another directional microphone having for instance an anti-cardioid polar pattern. The shared sound inlet 309, 310 is in acoustical connection with middle volumes 301 and 302, respectively. An acoustical resistance is arranged in sound inlet 309, 310. As addressed in relation to FIG. 2 the acoustical resistance may be formed by a grid. Again, the two directional microphones share the same outer housing or cabinet 311.

Figure 4:
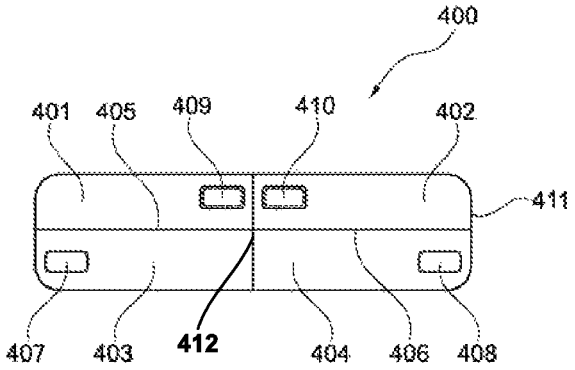
FIG. 4 shows a microphone module having separated middle sound inlets and separated middle volumes.

Referring now to the embodiment 400 shown in FIG. 4 the shared sound inlet of FIG. 3 has been separated into individual sound inlets 409 and 410 each holding an acoustical resistance. Otherwise the embodiment shown in FIG. 4 is identical to the embodiment shown in FIG. 3 with separated middle volumes 401 and 402, and separated front 403 and rear 404 volumes separated by common wall 412. The cardioid response is provided by membrane 405, whereas membrane 406 generates the anti-cardioid response. Cardioid and anti-cardioid responses are only used as examples. Membrane 405 and 406 may in principle generate any back-to-back polar patterns. The front 403 and rear 404 volumes are in acoustical communication with sound inlets 407 and 408, respectively. Similar to FIGS. 2 and 3 the two microphones share the same outer housing or cabinet 411.

Figure 5:
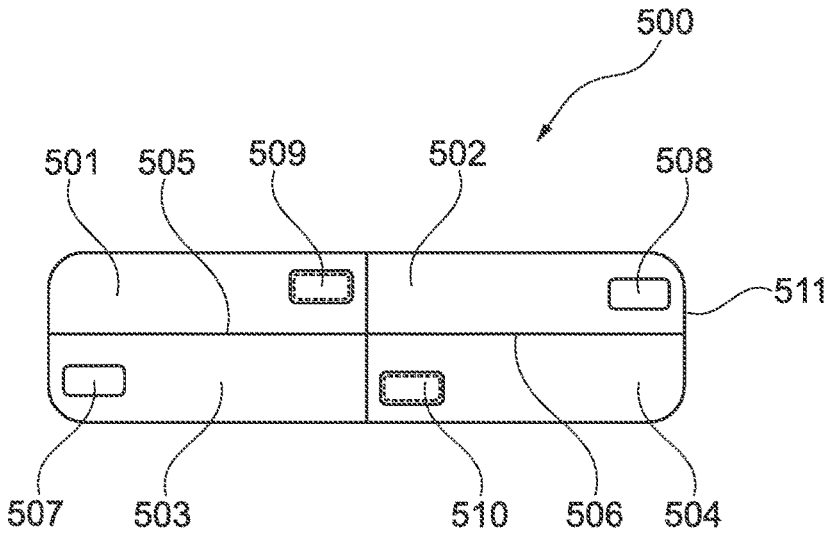
FIG. 5 shows a microphone module having separated middle sound inlets and separated middle volumes.

FIG. 5 shows an embodiment 500 being almost identical to the embodiment shown in FIG. 4. Again separated middle volumes 501 and 504 and separated front 503 and rear 502 volumes are applied. The cardioid response is provided by membrane 505, whereas membrane 506 generates the anti-cardioid response. Again, cardioid and anti-cardioid responses are only used as examples. Membrane 505 and 506 may in principle generate any back-to-back polar patterns. An acoustical resistance is provided in sound inlets 509 and 510, whereas sound inlets 507 and 508 are without any acoustical delays. Similar to FIG. 4 the two microphones share the same outer housing or cabinet 511.

Figure 6:
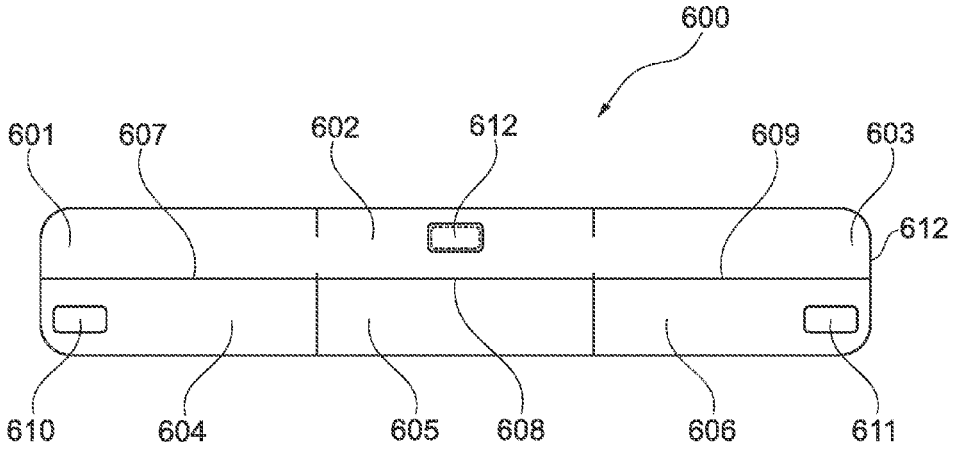
FIG. 6 shows a microphone module including an omni-directional microphone in a first position.

In FIG. 6 an omni-directional microphone has been added to two directional microphones to form an alternative embodiment 600 of the present invention. The omni-directional output is generated by membrane 608, whereas membrane 607 provides for instance a cardioid response and membrane 609 generates for instance an anti-cardioid response. The shared middle volume may be considered as three 601, 602, 603 acoustically connected volumes. The front 604 and rear volumes 605, 606 are separated. Sound inlets 610 and 611 are arranged with front 604 and rear 606 volumes, respectively. The middle volume 602 includes a sound inlet 612 having an acoustical resistance arranged therein. The omni-directional and the directional microphones share the same outer housing or cabinet 612.

Figure 7:
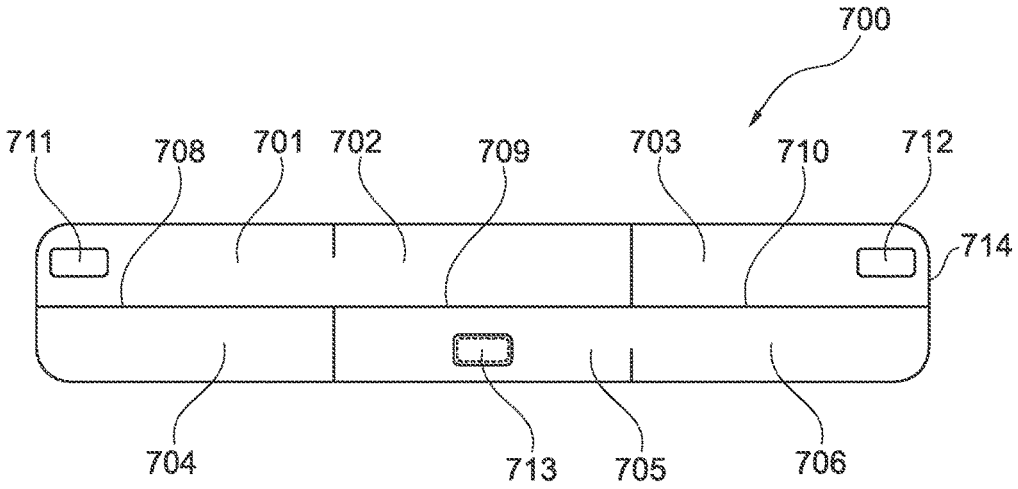
FIG. 7 shows a microphone module including an omni-directional microphone in a second position.

The embodiment of FIG. 7 is very similar to the embodiment shown in FIG. 6. Thus, in FIG. 7 an omni-directional microphone has been combined with two directional microphones to form an alternative embodiment 700. The omni-directional output is generated by membrane 708, whereas membrane 709 provides for instance a cardioid response and membrane 710 generates for instance an anti-cardioid response. The shared front volumes 701 and 702 are acoustically connected. The rear volumes 704 and 703 are acoustically separated, and the middle volumes 705 and 706 are acoustically connected. Sound inlets 711 and 712 are arranged with front volume 701 and rear volume 703, respectively. The middle volume 705 includes a sound inlet 713 having an acoustical resistance arranged therein. Again, theomni-directional and the directional microphones share the same outer housing or cabinet 714.

Figure 8:
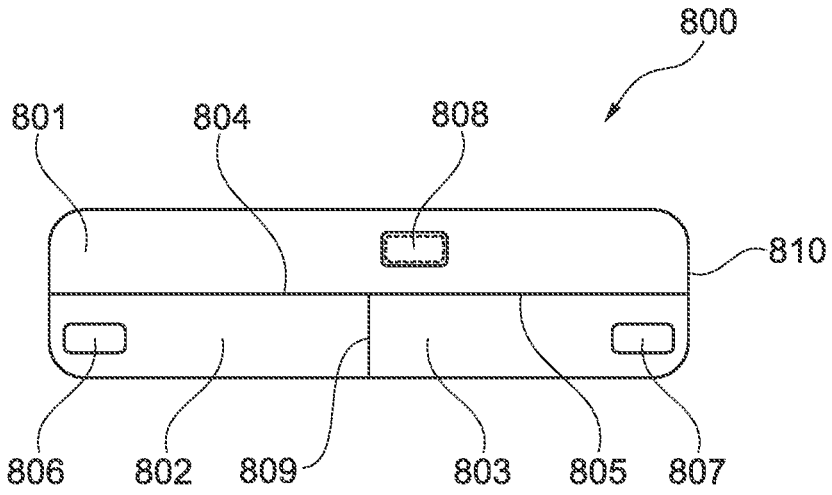
FIG. 8 shows a microphone module having a shared middle volume including a shared sound inlet being positioned off-centre.

The embodiment 800 depicted in FIG. 8 is similar to the embodiment of FIG. 2 except that the shared sound inlet 808 is positioned off-centre. Thus, FIG. 8 depicts a microphone module 800 comprising a shared middle volume 801, a front volume 802 and a rear volume 803. The front and rear volumes are acoustical separated by a wall 809. The middle volume 801, the front volume 802 and the membrane 804 form a directional microphone having for instance a cardioid polar pattern. Similarly, the middle volume 801, the rear volume 803 and the membrane 805 form another directional microphone having for instance an anti-cardioid polar pattern. An acoustical resistance is arranged in an off-centre sound inlet 808 whereas sound inlets 806 and 807 are holes. The acoustical resistance may be formed by a grid. An alternative way to obtain the off-centre effect is to bias the backplates (not shown) corresponding to the membranes 804 and 805 differently. The two directional microphones share the same outer housing or cabinet 810.

The invention claimed is:

1. A microphone module comprising a first directional microphone comprising a front volume and a front sound inlet hole being acoustically connected to a front membrane;

a second directional microphone comprising a rear volume and a rear sound inlet hole being acoustically connected to a rear membrane, wherein the front and rear volumes are separated by a common wall; and a middle sound inlet arrangement being acoustically connected to the front and rear membranes via separated middle volumes of the respective first and second directional microphones, wherein the middle volumes are separated by the common wall, the middle sound inlet arrangement comprising an acoustical resistance structure arranged at least partly therein.

2. A microphone module according to claim 1, wherein the first directional microphone has an essential cardioid polar pattern.

3. A microphone module according to claim 1, wherein the second directional microphone has an essential anti-cardioid polar pattern.

4. A microphone module according to claim 1, wherein the middle sound inlet arrangement comprises a shared sound inlet being acoustically connected to the respective separated middle volumes of the first and second directional microphones.

5. A microphone module according to claim 4, wherein the middle volume of the first directional microphone is acoustically connected to the front membrane, and wherein middle volume of the second directional microphone is acoustically connected to the rear membrane.

6. A microphone module according to claim 1, wherein the middle sound inlet arrangement comprises first and second sound inlets, wherein the first sound inlet is acoustically connected to the middle volume of the first directional microphone, and wherein the second sound inlet is acoustically connected to the middle volume of the second directional microphone.

7. A microphone module according to claim 6, wherein the middle volume of the first directional microphone is acoustically connected to the front membrane, and wherein middle volume of the second directional microphone is acoustically connected to the rear membrane.

8. A microphone module according to claim 1, wherein the first and second directional microphones are adjacently arranged.

9. A microphone module according to claim 8, wherein the middle sound inlet arrangement is positioned off-centre.

10. A microphone module according to claim 1, where the first and second directional microphones share a common microphone module housing.

11. A microphone module according to claim 1, further comprising an omni-directional microphone.

12. A microphone module according to claim 11, wherein the middle sound inlet arrangement forms part of the omni-directional microphone.

13. A microphone module according to claim 11, wherein the omni-directional microphone shares a front volume with one of the first and second directional microphones.

14. A microphone module according to claim 13, wherein the directional microphone sharing a front volume with the omni-directional microphone has an essential cardioid polar pattern.

15. A microphone module according to claim 11, where the first directional microphone, the second directional microphone, and the omni-directional microphone share a common microphone module housing.

16. A hearing aid comprising a microphone module according to claim 11.

17. A hearing aid comprising a microphone module according to claim 1.

* * * * *